United States Patent [19]

Esposito

[11] 4,132,033

[45] Jan. 2, 1979

[54] VARIABLE ALIGNMENT WINDOW ASSEMBLY

[76] Inventor: John D. Esposito, 7048 Ramoth Dr., Jacksonville, Fla. 32226

[21] Appl. No.: 833,734

[22] Filed: Sep. 16, 1977

[51] Int. Cl.[2] ..... E06B 7/28

[52] U.S. Cl. ..... 49/71; 49/402

[58] Field of Search ..... 49/402, 381, 40, 70, 49/71; 160/88, 107; 52/201; 47/40, 68

[56] References Cited

U.S. PATENT DOCUMENTS

| | | | |
|---|---|---|---|
| 1,188,096 | 6/1916 | Parker | 160/88 |
| 1,380,237 | 5/1921 | Neff | 47/40 X |
| 1,745,299 | 1/1930 | Holan | 160/88 |
| 2,434,859 | 1/1948 | McLoughlin | 160/107 X |
| 3,227,206 | 1/1966 | Rocco et al. | 160/88 |

*Primary Examiner*—Philip C. Kannan

*Attorney, Agent, or Firm*—George H. Baldwin; Arthur G. Yeager

[57] ABSTRACT

A variable alignment window assembly for mounting in a window frame of an enclosure which assembly allows greater light transmission and directional air admission into the enclosure, and which, when opened, may be used to shield out unwanted wind, rain, sun or observation from the outside, may be fabricated from one or more window units, each of which units has two vertically upright window panels angularly sealingly joined together along a common vertical side to form an outwardly projecting window unit having a common apical vertical edge and two vertical sides and means for vertically pivotally mounting, said means connecting a point on said window unit adjacent one of said vertical sides to one side of the window frame such that the unit is pivotable between a closed position, in which the vertical sides of the window are in sealing contact with the sides of the window frame, and an open position in which the vertical side of the unit which is not pivotally mounted to the window frame is outwardly remote of the window frame. A window assembly having two such units independently pivotally mounted centrally of the window frame is also disclosed. Also disclosed is a window unit comprising two vertically upright window panels individually pivotally mounted to and between an outwardly extending top and bottom of the window frame.

17 Claims, 10 Drawing Figures

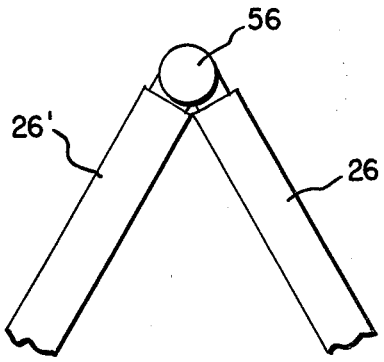
Fig. 7
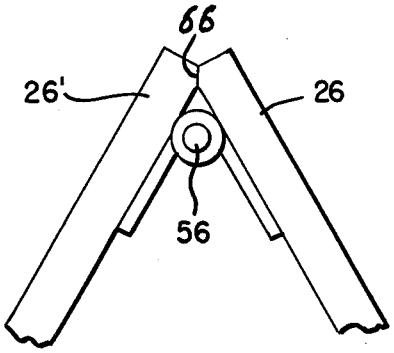
Fig. 8
Fig. 9
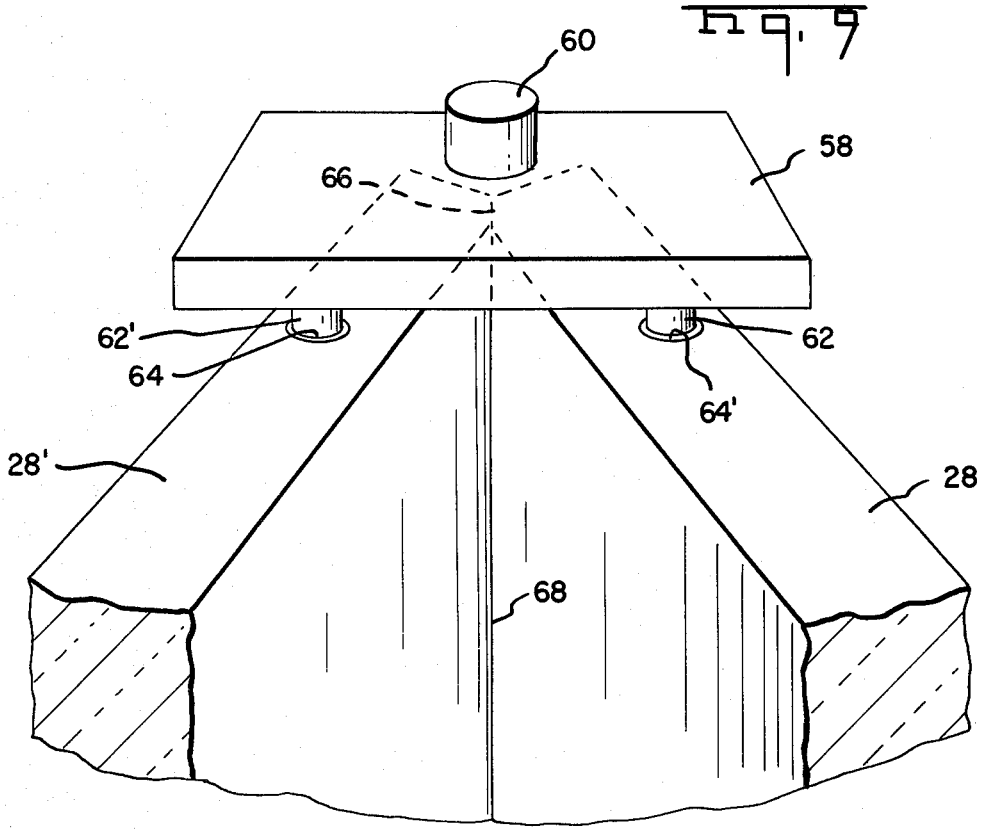

VARIABLE ALIGNMENT WINDOW ASSEMBLY

BACKGROUND OF THE INVENTION

This invention relates generally to windows for use in conjunction with enclosures and relates particularly to windows which are pivotable between open and closed positions.

As is well known to those skilled in the art, it is a universal practice to provide enclosures such as homes, office buildings, etc., with one or more windows in order to allow the infusion of daylight into the interior of such enclosures. In the vast majority of cases, such window units are so constructed that the windows may be opened in order to provide for the ingress and egress of fresh air. Many modes of operability have been utilized at one time or another to open such windows, such modes including vertical displacement along a pair of upstanding tracks in the window frame, pivotal motion about either a horizontal or vertical pivot axis at one edge or side of the window and rotation about a horizontal or vertical rotation axis running through the window unit at some point intermediate its height or length.

In order to allow the ingress of increased amounts of light to the enclosure in the immediate vicinity of the window, it is also well known to provide a semi-circular bow window or polygonal bay window which projects outwardly of the side of the exterior of an enclosure such as a house.

Despite the many and varied window assemblies which have been devised, none appears to offer the optimum combination of variable alignment which will allow the user to vary the amounts of light, air and visual privacy independently of each other.

SUMMARY

It has now been discovered that a window assembly for mounting in a window frame, which frame has a top, a bottom and two vertical lateral sides, may be fabricated as a first window unit having an inner window panel having an inner vertical side, apical vertical side, a top side and a bottom side; and an outer window panel having an outer vertical side, an apical vertical side, a top side and a bottom side, with the apical vertical side of the outer window panel sealingly rigidly angularly mounted to the apical vertical side of the inner window panel such that the respective apical vertical sides of the individual window panels are substantially co-extensive and project from the window frame in a direction outwardly of the enclosure and such that an apical angle is maintained between the outer and inner window panels of from about 1° to about 179°; and pivotal mounting means vertically pivotally mounting the inner vertical side of the unit to the window frame at a point adjacent the first lateral vertical side of the window frame such that the outer vertical side of the unit is pivotable from a closed position in sealing contact with the second lateral vertical side of the window frame to an open position with the outer vertical side of the window frame to an open position with the outer vertical side of the unit outwardly remote from the second vertical side of the window frame. Two such units may be mounted in the two window frames which are immediately adjacent each other and share a common lateral vertical side by independently pivotally mounting the units to points adjacent to the common lateral vertical side. Alternatively a window assembly for mounting in a window frame may comprise two such units which are independently vertically pivotally mounted centrally of the frame.

As a second alternative window assembly, the two vertically upright window panels of the window unit may be pivotally mounted to each other along respective apical vertical sides and said window unit co-axially pivotally mounted to, and between an outwardly extending top and bottom of the window frame.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 7 is a partial horizontal sectional view of one pivotal connection between two units;

FIG. 8 is a partial horizontal sectional view of another embodiment of a pivotal connection; and FIG. 9 is a perspective view partly in section of a third embodiment of a pivotal connection between the two units and the window frame.

DESCRIPTION OF THE PREFERRED EMBODIMENT

Figure 1:
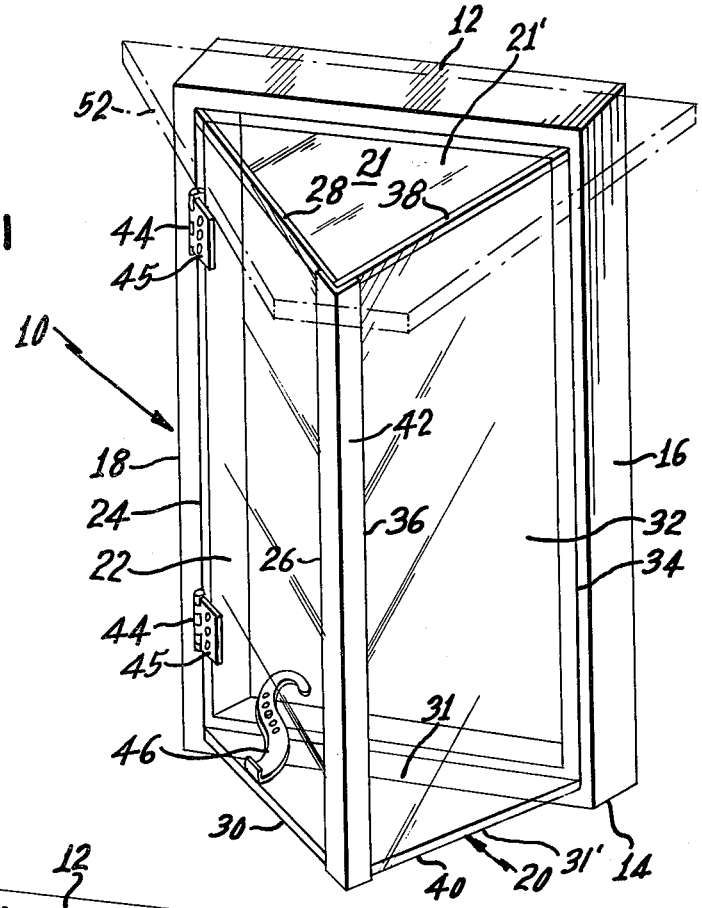
FIG. 1 is a perspective view of a single unit window assembly constructed in accordance with the invention and showing the unit in a closed position.
Figure 2:
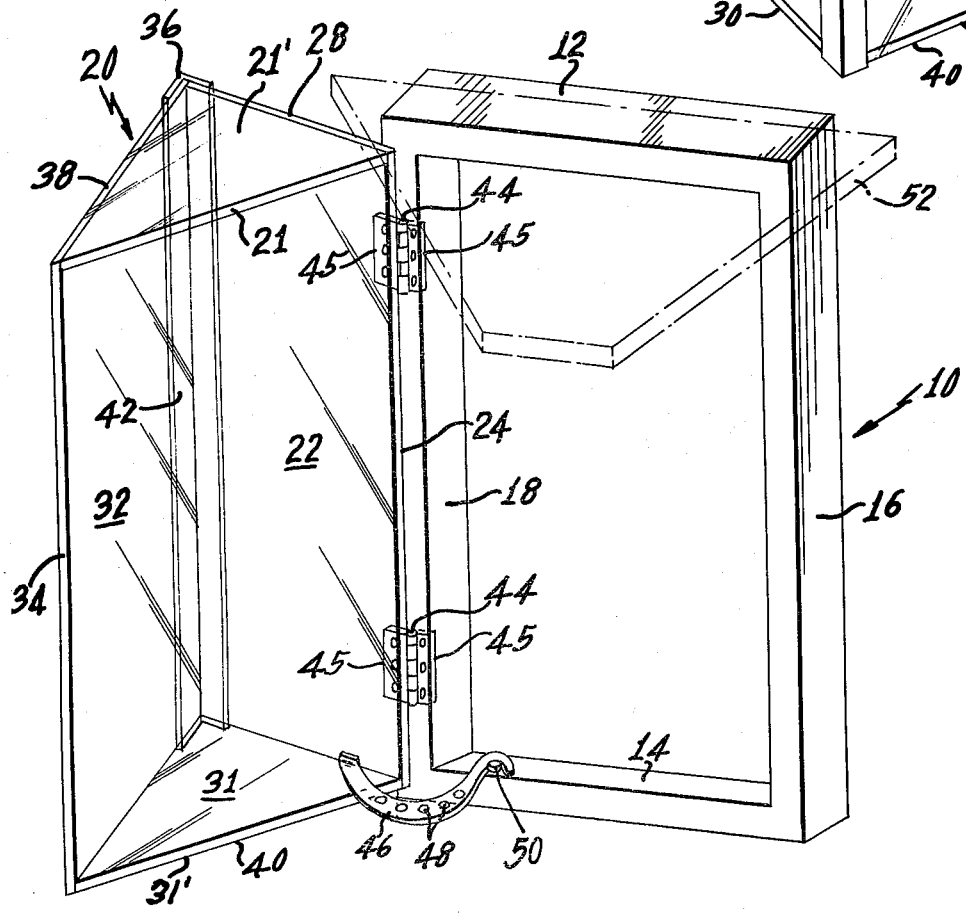
FIG. 2 is a perspective view of the assembly shown in FIG. 1 in an open position.

Referring to FIGS. 1 and 2, a window frame 10, having top 12, bottom 14 and vertical lateral sides 16 and 18, supports a window assembly, indicated generally at 20, constructed in accordance with one embodiment of the invention. Assembly 20 has inner window panel 22, having inner vertical side 24, apical vertical side 26, top side 28 and bottom side 30; outer window panel 32 having outer vertical side 34 apical vertical side 36, top side 38 and bottom side 40; top panel 21 and bottom panel 31. Inner window panel 22 and outer window panel 32 are rigidly sealingly angularly mounted together along their respective apical vertical sides 26 and 36 by sealing and mounting means such as elongated rigid strip 42, having longitudinal, panel-accepting grooves, not shown. A water-tight seal is formed between the two panels and such that the window panels are maintained at an angle therebetween of from about 1° to about 179°. A means for pivotally mounting, such as a pair of hinges 44 each having two wings 45, are mounted to window frame lateral side 18 and to inner vertical side 24 of inner window panel 22 such that assembly 20 is outwardly pivotable about the vertical pivot axes of the hinges. A variable position restrainment means such as downwardly biased resilient detent track 46 which is provided with a plurality of compatible detent holes 48, and detent pin 50 mounted to bottom 14 of a window frame 10, is connected to window assembly 20 at a point thereon adjacent the bottom of the assembly such that the position of assembly 20 may be restrained at any desired degree of pivot about hinges 44. Finally, window frame cap 52 project outwardly beyond the window assembly top to inhibit rain from entering the window opening when the window is in an open position.

As may be appreciated from a consideration of FIG. 1, the assembly may be pivoted to a fully closed orientation in which a snug, weather proof seal is obtained between the inner vertical side 24 and the first vertical lateral side 18, outer vertical side 34 and second vertical lateral side 16, and top panel side 21' and from top 12, and the bottom side 31' and frame bottom 14. As shown in FIG. 2, the window assembly is outwardly pivotable about the pivot axes of hinges 44 through a number of partially open positions of the fully open position shown in FIG. 2. In this fully open position the inner vertical side 34 of inner window panel 22 is maintained adjacent to lateral side 18 of window frame 10 by virtue of the interconnection formed therebetween by hinges 44. Outer vertical side 34 of outer window panel 32, however, is pivoted through an arcuate path to a position remote from its closed-position contact with lateral side 16 of the window frame. In like fashion, the top sides and bottom sides of the panels are outwardly removed from their points of sealing contact with frame top 12 and frame bottom 14 respectively. The assembly may be held in any of a variety of the partially open alignments (as well as the fully open and closed positions) by detent track 46 and pin 50. This variable alignment capability in combination with the apical configuration of the single unit window assembly is of great benefit to the user both for its light transmission characteristics and for its fresh air admittance capabilities. With respect to light transmission, the single unit assembly projects outwardly of the exterior wall of the enclosure thereby exposing the interior space of the assembly to greater amounts of light than would be transmitted through a conventional window. In addition, the apical configuration presents the possibilities of a prismatic effect wherein light falling obliquely on one of the window panels is transmitted therethrough to fall on the interior of the opposing panel wherefrom a portion of the light may be reflected into the interior of the enclosure. From the standpoint of fresh air admittance, since the window is pivotally openable to any desired orientation, the apical configuration of the assembly may be of particular utility in the case where a wind current is incident on the inner window panel. Under such a condition, the assembly may be opened to admit fresh air without exposing the interior of the enclosure to the force of the wind current. These advantages are especially beneficial in the event that the assembly is used to mount plants, flowers or the like, since the increased light exposure and the ability to expose the plants to fresh air while minimizing potential wind damage would be desirable in such a mode of use. In addition, by virtue of the ability to orient the window panels to one side of the window frame, the user may maintain his privacy from outside observers while enjoying the breeze and light admitted by the open window unit.

The assembly may, of course, be provided with any compatible accessories to modify the basic assembly in accordance with the requirements of a particular use. One such accessory may be a conventional sunlight reflector shade for use on either or both of window panels in the event that it is desired to exclude direct sunlight but to retain indirect sunlight. Such a shade may be mounted to the assembly such that it may be extended to cover either panel or held in retracted position.

As seen in FIGS. 1 and 2 an angular shaped window panel may be provided between the side panels 22 and 32. These top and bottom panels need not be transparent like panels 22 and 32, although such construction may not be as esthetically acceptable. It is understood that elongated outside corner strips similar to strip 36, but narrower, could be provided between top and bottom panels 21 and 32. The panels 21 and 31 serve not only to seal the top and bottom of the window to the frame when the assembly is fully closed, but they also rigidify the entire construction. Similar angular panels may be provided at any location or locations between the top and bottom panels 21 and 31 for attachment to side panels 22 and 32 for further rigidification and/or to function as shelves for the placement of small plants or other curio objects thereon.

Figure 3:
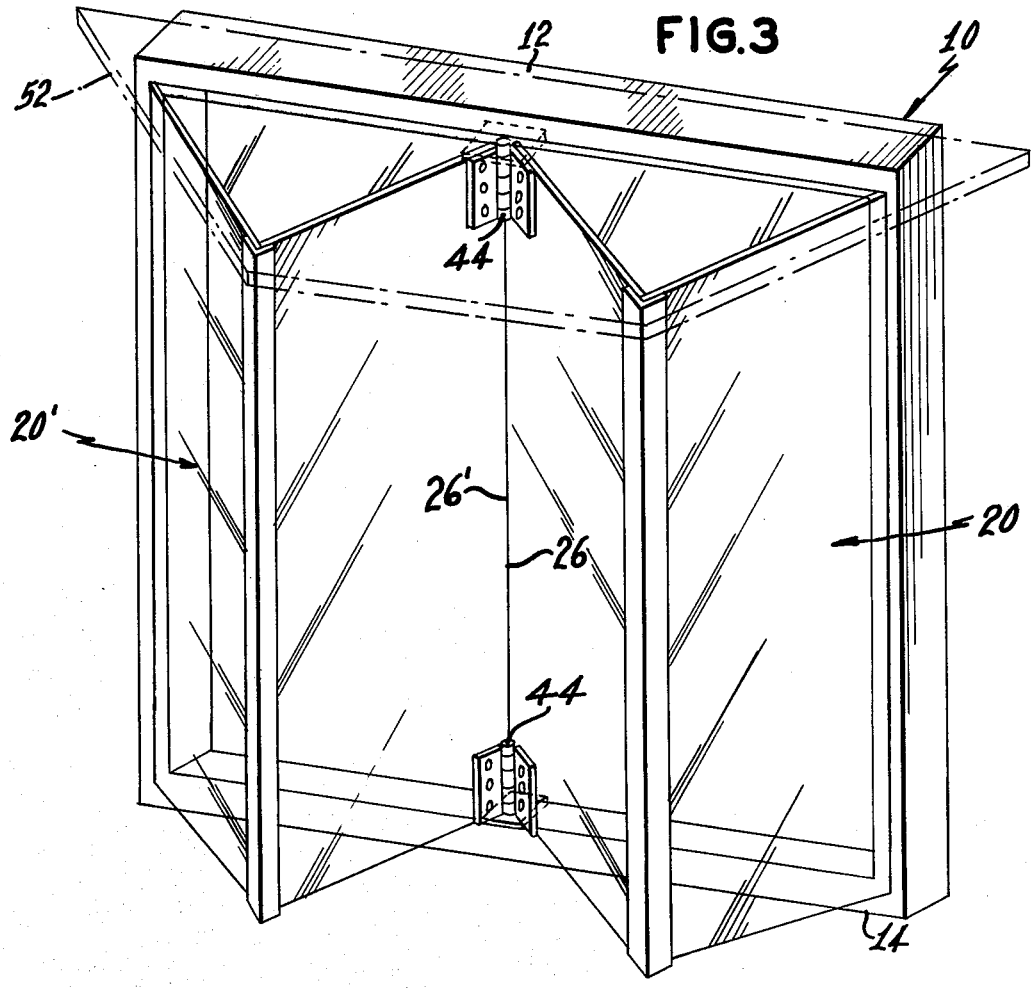
FIG. 3 is a perspective view of a dual unit window assembly constructed in accordance with a second embodiment of the invention in a closed position.

FIG. 3 discloses an alternative embodiment of the invention in which two window units of the same general type as that described above are pivotally mounted centrally of a window frame such that each unit is individually pivotable between open and closed positions. As is shown therein, inner vertical sides 26 and 26' of window units 20 and 20' respectively are pivotally mounted centrally of the window frame 10. Since each window unit of the window assembly is pivotable independently of the other, a variety of configurations such as those shown in FIGS. 4, 5 and 6, may be utilized.

Figure 4:
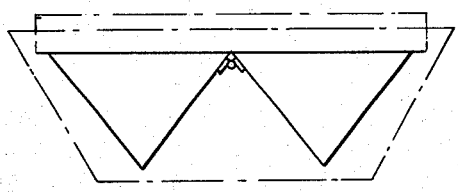
FIG. 4 is a reduced diagrammatic plan view of a dual unit window assembly in closed position.

FIG. 4 shows a horizontal sectional view of such a dual window unit assembly wherein each unit is in a closed orientation. As will be appreciated by those skilled in the art, light falling obliquely on the individual panels will be transmitted therethrough resulting both in illuminating the interior of the individual units and also in transmitting a greater amount of light into the enclosure by a prismatic effect.

Figure 5:
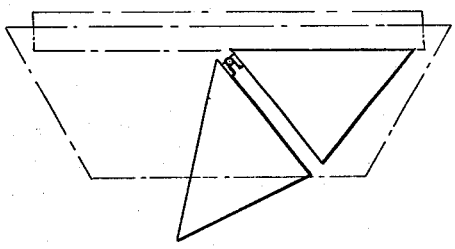
FIG. 5 is a reduced diagrammatic plan view of a dual unit window assembly having one unit in an open position.

FIG. 5 discloses an alternative orientation of the assembly which may be of particular utility in the event that a right-to-left wind current is incident on the assembly. Under such conditions the assembly may be opened to admit fresh air to the enclosure without exposure to wind gusts by pivoting the left hand window unit into an open position but leaving the right hand unit closed. As is obvious, the orientation of the units may be reversed in the instance that the wind current is from left to right.

Figure 6:
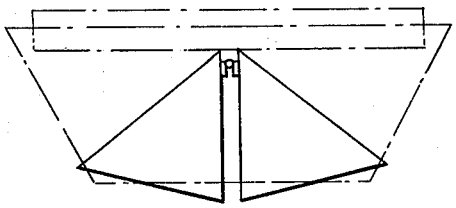
FIG. 6 is a reduced horizontal sectional view of a dual unit window assembly having both units in partially open position.

FIG. 6 discloses an alternative embodiment which is of particular utility when there is minimal wind current and ventillation of the enclosure is desired. In such an orientation having each window unit partially open, plants which may be mounted in the window may be aired and exposed to direct sunlight.

The hinge pins of the hinges 44 may be mounted to the frame cap 52 and still (not shown in FIG. 3) or to the top and bottom framing elements 12 and 14 as will be apparent to those skilled in the art.

FIGS. 7, 8 and 9 show alternative means for pivotally mounting the two units. FIG. 7 discloses the use of an elongated pivot axle 56 to which the two inner vertical sides of the respective window units have been mounted. FIG. 8 shows pivot axle 56 pivotally mounting the two units at points therebetween adjacent the respective inner vertical sides. FIG. 9 discloses a third alternative for pivotally mounting which comprises a mounting plate 58 having window frame anchor 60 for rigidly connecting to the window frame. Mount 58 carries two pivotal mounting lugs 62 and 62' for insertion in compatible mounting lug holes 64 and 64' of top sides 28 and 28' respectively of the two window units. A comparable mounting plate may be utilized to mount bottom sides 30 and 30' to window frame bottom 14. Inner vertical sides 26 and 26' may be beveled along their facing edges as shown at 66 so as to form a weather proof seal 68 when the units are each in the closed position.

Figure 10:
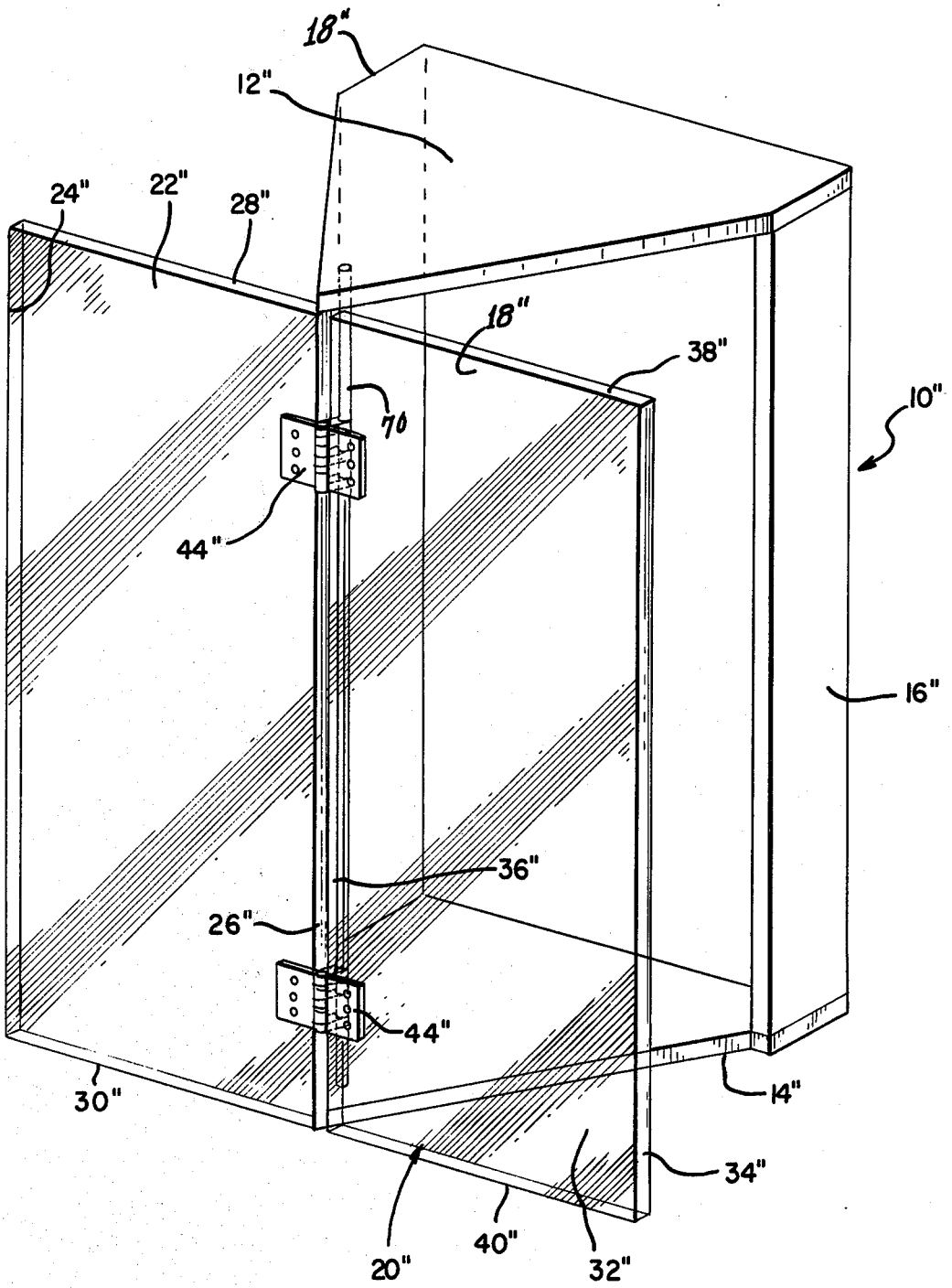
FIG. 10 is a perspective view of an alternative single unit window assembly.

Referring to FIG. 10 there is seen an alternative embodiment of the single unti window assembly, indicated generally at 20". Unit 20" is mounted in a window frame 10" having an outwardly extending top 12", an outwardly extending bottom 14" and two vertical lateral sides 16" and 18". Window unit 20" has first window panel 22" having inner vertical side 24" apical vertical side 26" top side 28" and bottom side 30", and outer window panel 32" having outer vertical side 34", apical vertical side 36" top side 38" and bottom side 40". Inner window panel 22" and outer window panel 32" are vertically pivotally mounted to and between window frame top 12" and window frame bottom 14" adjacent the respective outwardly extending ends of the frame top and bottom, and are individually pivotally mounted to each other along their respective apical vertical sides 26" and 36" such that the pivot axes are coaxial. This pivotal mounting arrangement may be accomplished either with one pivot axis which is pivotally anchored between the frame top and bottom and which pivotally mounts the individual window panels. Alternatively the individual window panels may be hinged to a stile 70 by hinges 44" or the hinged pair of window panels may be mounted to frame top and bottom by pivotal mounting means such as those shown in FIGS. 7 and 8, such that the pivot axis of the mounting means and the pivot axes of the hinges 44" panels are co-axial. Individual detent means similar to that shown in FIGS. 1 and 2, or their equivalent, not shown, may be mounted to each window panel such that the relative orientation of each panel with respect to the other panel and to the window frame may be securingly adjusted.

Through the use of such a window unit, each window panel may be individually pivotable between a closed position in sealing contact with the window frame and an open position wherein the side opposite the apical vertical side is remote from its associated vertical side of the window frame. Thus either or both window panels may be pivoted into a position such that fresh air and light are admitted but wind and unwanted observation from outside are avoided. While one window panel 32" may be pivoted from its closed position to one in which it lies substantially in the plane of the closed position of window panel 22", and thus theoretically permitting each panel to be swung between a range of from about 1° to about 179°, the practical range is more in the order of 30° to 150°, as will be apparent to those skilled in the art.

The various embodiments of the window assembly described herinabove may be complimented by the use of any one or more of several accessory devices such as a screen mounted to the window frame interiorly of the assembly or the sun shade disclosed above. In addition, suitable weather stripping, glazing or fillets may be utilized by those skilled in the art in order to provide proper environment for the assembly.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A variable alignment window assembly for mounting in a window frame of an enclosure, said window frame having a first vertical lateral side, a top and a bottom, said assembly comprising:
   a. an inner window panel having an inner vertical side, an apical vertical side, a top side and a bottom side; and
   b. an outer window panel having an outer vertical side, an apical vertical side, a top side and a bottom side;
   c. means for rigidly angularly mounting said inner window panel to said outer window panel along the respective apical vertical sides of said panels such that said apical vertical sides of said panels are co-extensive and are held exteriorly of said window frame at an angle between said panels of from about 1° to about 179°; and
   d. means for pivotally mounting said first window unit to said window frame, said means being attachable to said inner window panel adjacent said inner vertical side thereof and to said window frame adjacent said first vertical lateral side thereof; so constructed and arranged that said assembly is pivotally mounted to said window frame adjacent a first vertical lateral side thereof and pivotable between a closed position in which said inner vertical side is co-extensive, and in sealing contact, with said first vertical lateral side of said window frame and in which said outer vertical side is co-extensive, and in sealing contact, with the second vertical lateral side of said window frame and an open position in which said outer vertical side is outwardly remote from said second vertical lateral side of said window frame.

2. The window assembly as set forth in claim 1 wherein said means for rigidly angularly mounting comprises an elongated rigid strip having a pair of portions connecting said respective apical sides of said inner and said outer window panels.

3. The window assembly as set forth in claim 2 wherein said means for pivotally mounting comprises a hinge having a first wind portion rigidly secured to said first vertical lateral side of said window frame and a second wing portion rigidly secured to said inner window panel adjacent said inner vertical side thereof.

4. The window assembly as defined in claim 1 further comprising detent means mounted between said window assembly and said frame for securingly fixing the angular relationship of said assembly with respect to said frame.

5. The window assembly as defined in claim 1 further comprising a top window panel and a bottom window panel connected respectively to said inner and outer window panel top sides and bottom sides.

6. A variable alignment window assembly for mounting in a window frame of a building, said frame having two vertical lateral sides, a top and a bottom, said assembly comprising:

a. a pair of window units, each said window unit comprising:

(1) an outer window panel having an outward vertical side, an apical vertical side, a top side and a bottom side; and (2) an inner window panel having an inward vertical side, an apical vertical side, a top side and a bottom side;

(3) means for rigidly angularly connecting said outer window panel to said inner window panel along the respective apical vertical sides of said outer and inner window panels such that an angle is maintained between said panels of from about 1° to about 179°;

b. means for vertically pivotally mounting said pair of window units to said top and bottom of said window frame and centrally thereof, said means for vertically pivotally mounting being attachable to each respective said inner vertical side of each said window unit in said pair of window units, so constructed and arranged that said apical vertical sides of said window panels of each said unit extend outwardly of said window frame, each said unit being individually pivotable between a closed position, in which said outward vertical side of each said unit is in sealing contact with a lateral side of said window frame, and an open position, in which said outward vertical side of each said unit is remote from said lateral side of said window frame, and wherein said inner window panel of one said unit is adjacent and substantially parallel to said inner window panel of the other said unit.

7. The window assembly as set forth in claim 6 wherein said means for rigidly angularly mounting comprises a pair of elongated rigid strips each having a pair of portions connecting said respective apical sides of said inner and said outer window panels of respective said units.

8. The window assembly as set forth in claim 6 wherein said means for vertically pivotally mounting comprises a hinge having a first wing portion rigidly secured to said apical vertical side of said outer window panel and a second wing portion rigidly secured to said apical vertical side of said inner window panel.

9. The window assembly as defined in claim 8 wherein said means for vertically pivotally mounting comprises a vertical stile, said hinge having another wing portion rigidly secured to said stile.

10. The window assembly as defined in claim 6 wherein said means for vertically pivotally mounting includes a pair of pivotal axes respectively for each unit, said axes being substantially co-axial and vertically disposed.

11. The window assembly as defined in claim 6 further comprising detent means mounted between each of said units and said frame for securingly fixing the angular relationship of each said unit with respect to said frame.

12. The window assembly as defined in claim 11 wherein said detent means comprises independently adjustable means for each said unit whereby the angular relationship between said units may be adjusted.

13. The window assembly as defined in claim 6 wherein said units are mounted to a shaft fixed with respect to said top and bottom of said window frame.

14. The window assembly as defined in claim 6 wherein each said unit includes a top window panel and a bottom window panel connected respectively to said inner and outer window panel top sides and bottom sides of respective said units.

15. The window assembly as defined in claim 14 wherein said top and bottom window panels include an apex having an angle substantially equal to said angle between said outer and inner window panels.

16. A variable alignment window assembly for mounting in a window frame, said window frame having a first vertical frame side, a second vertical frame side, an outwardly extending top side, and an outwardly extending bottom side, said variable alignment window assembly comprising:

a. a first vertically upright window panel said first panel having an inner vertical side, an apical vertical side;

b. a second vertically upright window panel said second panel having an outer vertical side an apical vertical side;

c. means for pivotally mounting being rigidly attachable to said outwardly extending top and bottom sides, for individually pivotally mounting said first window panel and said second window panel along a vertical pivot axis adjacent respective said apical sides of said first and said second window panels; and d. a variable position detent means in contact with said window panels independently securingly adjusting the angular relationship between said first and said second window panel.

17. The window assembly as defined in claim 16 wherein said means for pivotally mounting includes a vertical stile extending between said top and bottom and hinge means connected to said stile and to each said window panels.

* * * * *